US009793641B1

(12) United States Patent
Eiden et al.

(10) Patent No.: US 9,793,641 B1
(45) Date of Patent: Oct. 17, 2017

(54) PLUG RECEPTACLE FOR AN ELECTRONIC DEVICE

(71) Applicant: Microsoft Technology Licensing, LLC, Redmond, WA (US)

(72) Inventors: Niko Eiden, Espoo (FI); Ville Vehkaperä, Oulu (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/233,874

(22) Filed: Aug. 10, 2016

(51) Int. Cl.

| | |
|---|---|
| ***H01R 13/453*** | (2006.01) |
| ***H01R 24/58*** | (2011.01) |
| ***H01R 24/60*** | (2011.01) |
| *H01R 107/00* | (2006.01) |

(52) U.S. Cl.
CPC ..... *H01R 13/453* (2013.01); *H01R 24/58* (2013.01); *H01R 24/60* (2013.01); *H01R 2107/00* (2013.01); *H01R 2201/06* (2013.01)

(58) Field of Classification Search
CPC .. H01R 13/453; H01R 13/447; H01R 13/639; H01R 12/774; H01R 24/58; H01R 24/60; H01R 2107/00; H01R 2201/06
USPC ..... 439/137, 136, 147, 668
See application file for complete search history.

(56) References Cited

U.S. PATENT DOCUMENTS 4,937,404 A * 6/1990 Kitagawa ..... H01R 13/7035 200/51.09
5,395,268 A * 3/1995 Okada ..... H01R 24/62 439/352
5,692,914 A * 12/1997 Mitani ..... H01R 13/639 439/131
7,854,633 B2 12/2010 Lynch et al.
8,348,684 B2 * 1/2013 Ladouceur ..... H04M 1/0274 439/131
8,353,729 B2 1/2013 Dabov et al.
8,449,311 B2 5/2013 Montena
(Continued)

FOREIGN PATENT DOCUMENTS

CN 201639618 U 11/2010
CN 202602742 U 12/2012
(Continued)

OTHER PUBLICATIONS

Linder, Brad, "Asus 1015E review: 10 inch notebook with a Celeron 847 CPU", Published on: May 18, 2013, 25 pages, Available at: http://liliputing.com/2013/05/asus-1015e-low-cost-mini-notebook-review.html.

*Primary Examiner* — Tulsidas C Patel
*Assistant Examiner* — Travis Chambers

(57) ABSTRACT

A plug receptacle is disclosed, comprising a receptacle housing having a passage configured to receive at least a part of a plug of a plug connector, a front side having a first opening and a top side having a second, elongated opening that intersects the first opening, the passage opening to the front side via the first opening and to the top side via the second opening. The plug receptacle also comprises at least one plug receptacle cover that is reversibly extendable between a cover position and an open position. In the cover position, the at least one plug receptacle cover covers the second opening at least partially. In the open position, at least a part of the at least one plug receptacle cover is extended outwards, so that the at least the part of the plug partially extends through the second opening.

20 Claims, 4 Drawing Sheets

(56) References Cited

U.S. PATENT DOCUMENTS

| | | | | |
|---|---|---|---|---|
| 8,529,288 | B2 * | 9/2013 | Montena | H01R 13/5213 439/523 |
| 8,696,391 | B2 * | 4/2014 | Ladouceur | H01R 13/639 439/668 |
| 9,356,408 | B1 * | 5/2016 | Biddle | H01R 24/76 |
| 2001/0019907 | A1 * | 9/2001 | Glad | H01R 13/44 439/131 |
| 2004/0203515 | A1 | 10/2004 | Kuriyama | |
| 2013/0034979 | A1 * | 2/2013 | Chang | G06F 1/1656 439/131 |
| 2014/0134859 | A1 | 5/2014 | Lee et al. | |
| 2015/0263443 | A1 | 9/2015 | Zhang et al. | |

FOREIGN PATENT DOCUMENTS

| | | | |
|---|---|---|---|
| CN | 202817317 | U | 3/2013 |
| CN | 103326168 | A | 9/2013 |
| CN | 203398401 | U | 1/2014 |
| CN | 203423304 | U | 2/2014 |
| CN | 203826662 | U | 9/2014 |
| WO | 2015172697 | A1 | 11/2015 |

* cited by examiner

PLUG RECEPTACLE FOR AN ELECTRONIC DEVICE

BACKGROUND

Many electronic devices such as mobile phones, MP3 players and various portable audio devices may require or allow the use of external audio earphones, headphones or a head set in order to play media sound. A microphone may be required in order to talk to a caller on a mobile phone when, for example, a head set is connected to the mobile phone.

Standard connectors may be available with standard sizes. Standard audio connectors or plugs are popular in three sizes based on the outside diameter of the plug: 6.35 mm, 3.5 mm and 2.5 mm plugs. Standard receptacles for such connectors may include an opening having an interior diameter sized so that it can receive and engage the plug and may, for example, therefore exceed 3.5-4 mm for a 3.5 mm audio connector.

For thin electronic devices, the thickness of such a standard receptacle may be challenging to accommodate. The standard receptacle may be thicker than the electronic device, or the standard receptacle may take up so much space within the electronic device that it may be more challenging to fit internal components such as a display, electronics, a battery etc. inside the electronic device.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A plug receptacle is disclosed. The plug receptacle may comprise a receptacle housing having a passage configured to receive at least a part of a plug of a plug connector, a front side having a first opening and a top side having a second, elongated opening that intersects the first opening, the passage opening to the front side via the first opening and to the top side via the second opening. The plug receptacle may further comprise at least one plug receptacle cover that is reversibly extendable between a cover position and an open position, wherein in the cover position, the at least one plug receptacle cover covers the second opening at least partially; and in the open position, at least a part of the at least one plug receptacle cover is extended outwards, the plug receptacle thereby being configured to receive the at least the part of the plug so that the at least the part of the plug partially extends through the second opening.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein:

In FIGS. 1 to 6C, the plug receptacles and electronic devices are illustrated as schematic drawings. The drawings may not be to scale.

DETAILED DESCRIPTION

The detailed description provided below in connection with the appended drawings is intended as a description of a number of embodiments and is not intended to represent the only forms in which the embodiments may be constructed, implemented, or utilized.

Figure 1A:
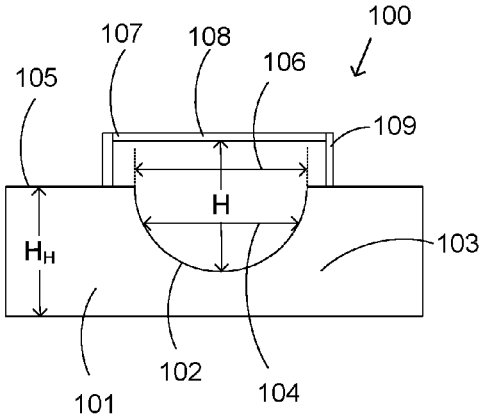
FIGS. 1A and 1B illustrate cross-sectional views and details of an embodiment of a plug receptacle.

The plug receptacle 100 of FIG. 1A is shown as a cross-sectional view. The plug receptacle 100 comprises a receptacle housing 101 having a passage 102, which is configured to receive and engage at least a part of a plug 111 of a plug connector 110; the plug connector 110 is, however, not shown in FIG. 1A. The passage 102 may be, but is not necessarily longitudinal. In this cross-sectional view, the passage 102 has an arcuate or semi-circular cross-section to fit against the circular plug 111. However, the cross-section of the passage 102 is not particularly limited to being arcuate, partially circular or semi-circular in shape, but may be e.g. rectangular. The receptacle housing 101 has a front side 103 having a first opening 104. The passage 102 opens to the front side 103 via the first opening 104 so that when in use, the at least the part of the plug 111, i.e. a part of the plug or the entire plug, may be inserted into the passage 102 through the first opening 104. The receptacle housing 101 further has a top side 105 having a second opening 106. The passage 102 opens to the top side 105 via the second opening 106. The top side 105 is adjacent to the front side 103. Although it cannot be directly seen in FIG. 1A, the second opening 106 is elongated. In this embodiment, the second opening 106 extends perpendicularly into the passage 102. The first opening 104 and the second opening 106 intersect to form a continuous opening via which the passage 102 opens to the top side 105 and to the front side 103.

It should be understood that terms such as "front side", "top side", "bottom side", "top", "bottom", "side" and "below" are merely for ease of description and not intended to indicate the orientation of the sides in which they are specifically configured to be when in use. For example, when in use, the front side or the top side may be disposed upward, downward, frontward or backward.

The plug receptacle 100 further comprises at least one plug receptacle cover 107. The plug receptacle cover 107 is reversibly extendable. In this exemplary embodiment, the plug receptacle cover 107 is a part of a plug receptacle cover arrangement 108 comprising one or more support members 109 that may be but need not be reversibly extendable. The support members 109 connect the plug receptacle cover 107 to the receptacle housing 101. The plug receptacle cover 107 is extendable between a cover position and an open position. In FIG. 1A, the plug receptacle cover 107 is shown in the cover position. In the cover position, the plug receptacle cover 107 is unextended. Although unextended, it may be taut and/or pretensioned in the cover position. Such a taut and/or pretensioned plug receptacle cover 107 may be more prone to reversibly return to the cover position. In the cover position, the plug receptacle cover 107 covers the second opening 106 at least partially. The plug receptacle cover 107 and the passage 102 define a space having a height H in the cover position.

Figure 1B:
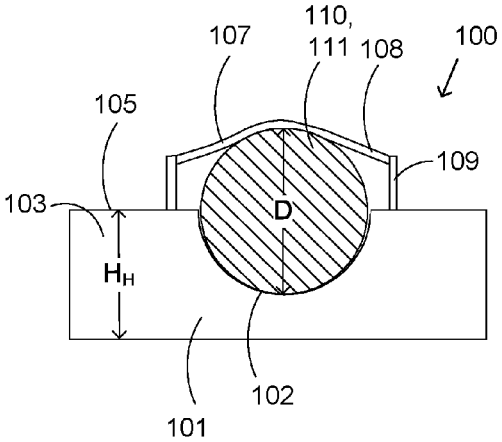

FIG. 1B illustrates the plug receptacle 100 of FIG. 1A in an open position, according to an embodiment. In the open position, the at least the part of the plug 111 of a plug connector 110 is disposed in the plug receptacle 100. The term "plug" may be understood as referring to the male electric contact portion of a plug connector; a plug connector may comprise, in addition to the plug itself, other components such as a shell for gripping the plug connector. The plug receptacle cover 107 and the passage 102 define a space having a height H smaller than the height of the at least the part of the plug 111 or, in this exemplary case of a plug having a circular cross-section, smaller than the diameter D (outer or cross-sectional diameter) of the at least the part of the plug 111. Upon being inserted into the plug receptacle 100, the at least the part of the plug 111 forces at least a part of the plug receptacle cover 107 to extend outwards, i.e. away from the passage. The plug receptacle cover 107 may thus elastically deform to the open position upon insertion of the at least the part of the plug 111. Being reversibly extendable, it may return or revert to the cover position upon removal of the at least the part of the plug 111. The plug receptacle 100 is thus configured to receive the at least the part of the plug 111 when the plug receptacle cover 107 is in the open position. In the open position, the at least the part of plug 111 received extends through the second opening 106, i.e. beyond the top side 105 of the receptacle housing 101. The width of the first opening 104 and the width of the passage 102 may be equal to or greater than the diameter D of the at least the part of the plug 111.

In an embodiment, the height $H_H$ of the receptacle housing 101 is smaller than the height of the at least the part of the plug 111. In an embodiment in which the at least the part of the plug 111 has a circular cross-section, the height of the at least the part of the plug 111 corresponds to its diameter D, so that the height $H_H$ of the receptacle housing 101 is smaller than the diameter D of the at least the part of the plug 111.

The material of the plug receptacle cover 107 may be non-conductive, in particular the parts of the plug receptacle cover 107 that are configured to be in contact with the at least the part of the plug 111. Alternatively, the plug receptacle cover 107 may comprise or be mainly formed of a conductive material, such as an alloy or composite metal, provided that the parts of the plug receptacle cover 107 that are configured to be in contact with the at least the part of the plug 111 are coated or covered with a layer of non-conductive material. In the embodiment shown in FIGS. 1A and 1B, the plug receptacle cover 107 may be resilient. Such a resilient plug receptacle cover 107 may be formed of a resilient material, so that the plug receptacle cover 107 is reversibly stretchable between the cover position and the open position. Suitable resilient materials may be e.g. rubber, including natural rubber, silicone, foam, a suitable plastic, or any mixtures thereof, although other resilient materials may also be contemplated. As the plug receptacle cover 107 is stretched when in the open position, it tends to try to revert to the cover position. In an embodiment, the plug receptacle cover 107 is configured to exert a force against the at least the part of the plug 111 in the open position, thereby engaging the at least the part of the plug 111. The thickness of the plug receptacle cover 107 may be approximately 1 mm, but may be smaller or greater.

In an embodiment, the plug receptacle 100 is an audio plug receptacle. In an embodiment, the audio plug receptacle is configured to receive and engage at least a part of an audio plug having a circular cross-section. In an embodiment, the plug receptacle 100 is an audio plug receptacle configured to receive at least a part of the plug of a standard 2.5 mm (3/32"), or 3.5 mm (1/8"), or 6.35 mm (1/4") audio plug connector. Such connectors are also referred to as audio jacks or jack plugs. The plug receptacle 100 may thus be referred to as a socket or jack socket.

The plug receptacle 100 may further comprise one or more electric contacts. The one or more electric contacts, for example a plurality of electric contacts, may be disposed within the passage 102.

Figure 2A:
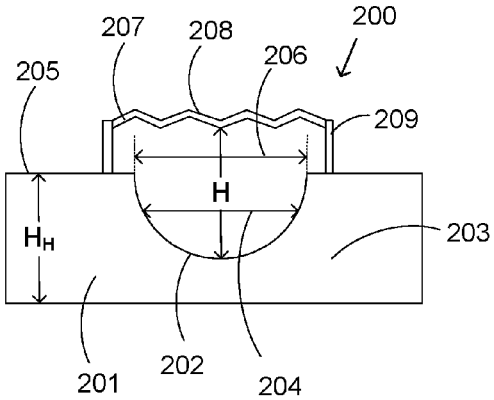
FIGS. 2A and 2B illustrate cross-sectional views and details of an embodiment of a plug receptacle.
Figure 2B:
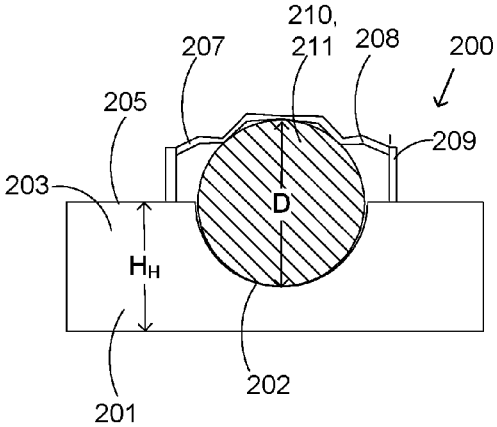

The plug receptacle 200 of FIGS. 2A and 2B differs from that of FIGS. 1A and 1B at least in that the plug receptacle cover 207 comprises a pleated portion 208. The pleated portion 208 is reversibly extendable. In the open position shown in FIG. 2B, the pleats of the pleated portion 208 are at least partially opened so that in the cover position the pleated portion 208 is reversibly extended relative to the pleated portion 208. Other aspects of the embodiment shown in FIGS. 2A and 2B are generally similar to those of the embodiment shown in FIGS. 1A and 1B.

Figure 3A:
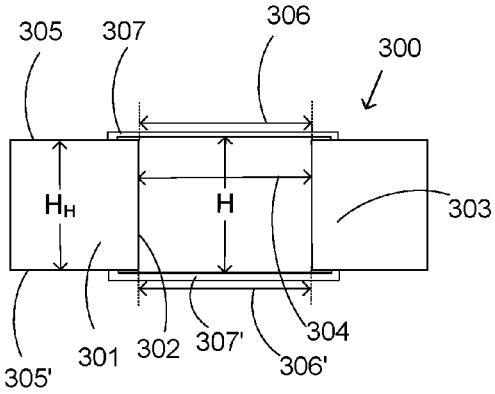
FIGS. 3A and 3B illustrate cross-sectional views and details of an embodiment of a plug receptacle.
Figure 3B:
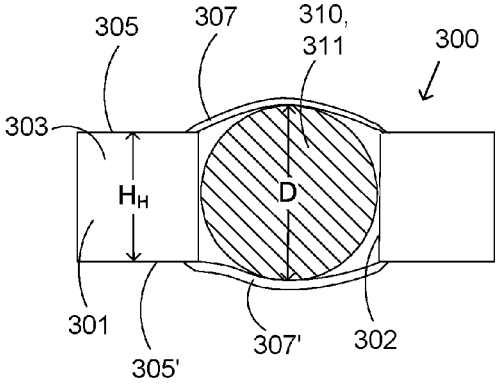

The plug receptacle 300 of FIGS. 3A and 3B differs from that of FIGS. 1A, 1B, 2A and 2B at least in that the receptacle housing 301 has a bottom side 305' having a third opening 306'. The bottom side 305' is a side opposite to the top side 305. The passage 302, which is configured to receive and engage at least a part of a plug 311 of a plug connector 310, opens to the bottom side 305' via the third opening 306'. In this cross-sectional view of this exemplary embodiment, the passage 302 has a rectangular cross-section. In other embodiments, the passage 302 may have e.g. an arcuate or partially circular cross-section to fit against the at least the part of the circular plug 311. However, other shapes for the cross-section of the passage 302 may also be contemplated. The receptacle housing 301 has a front side 303 having a first opening 304. The passage 302 opens to the front side 303 via the first opening 304 so that when in use, the at least the part of the plug 311 may be inserted into the passage 302 through the first opening 304. The receptacle housing 301 further has a top side 305 having a second opening 306. The passage 302 opens to the top side 305 via the second opening 306. Although not directly visible in FIG. 3A, the second opening 306 and the third opening 306' are elongated. In this embodiment, the second opening 306 and the third opening 306' extend perpendicularly into the passage 302. The first opening 304, the second opening 306 and the third opening 306' intersect to form a continuous opening, via which the passage 302 opens to the front side 303, the top side 305 and the bottom side 305'. In an embodiment, the third opening 306' has a width equal to the width of the second opening 306. In an embodiment, the third opening 306' has a length equal to the length of the second opening 306.

The plug receptacle 300 further comprises a first plug receptacle cover 307 at the top side 305 of the receptacle housing 301 and a second plug receptacle cover 307' at the bottom side 305' of the receptacle housing 301. In this exemplary embodiment, the entire first and second plug receptacle cover 307, 307' may be reversibly extendable. The first and second plug receptacle cover 307, 307' are thus extendable between a cover position and an open position. In an embodiment, the first and second plug receptacle cover 307, 307' are simultaneously extendable between a cover position and an open position. In FIG. 3A, both plug receptacle covers 307, 307' are shown in the cover position covering the second opening and the third opening, respectively. In the cover position, the plug receptacle covers 307, 307' are unextended. Although unextended, they may, independently of each other, be taut and/or pretensioned in the cover position. Such a taut and/or pretensioned plug receptacle cover 307, 307' may be more prone to reversibly return to the cover position. In this embodiment, the entire first and second plug receptacle covers 307, 307' may be of a resilient material, such as any resilient material described in this specification. In other embodiments, either the first or the second plug receptacle cover 307, 307' or both could be replaced with a different type of plug receptacle cover, such as any one of the plug receptacle covers described in FIGS. 1A to 2B.

In the cover position, the first and second plug receptacle covers 307, 307' cover the second opening 306 and the third opening 306', respectively, at least partially. The plug receptacle covers 307, 307' and the passage 302 define a space having a height H in the cover position.

FIG. 3B illustrates the plug receptacle 300 of FIG. 3A in an open position, according to an embodiment. In the open position, at least a part of a plug 311 of a plug connector 310 is disposed in the plug receptacle 300. The plug receptacle covers 307, 307' and the passage 302 define a space having a height H smaller than the height of the at least the part of the plug 311 or, in this exemplary case of a plug having a circular cross-section, smaller than the diameter D of the at least the part of the plug 311. Upon being inserted into the plug receptacle 300, the at least the part of the plug 311 forces the reversibly extendable first and second plug receptacle cover 307, 307' to extend outwards. The plug receptacle cover 300 is thus configured to receive the at least the part of the plug 311 when the first and second plug receptacle cover 307, 307' are in the open position. In the open position, at least a part of the at least the part of the plug 311 received extends through the second opening 306, i.e. beyond the top side 305 of the receptacle housing 301, and through the third opening 306', i.e. beyond the bottom side 305' of the receptacle housing 301.

In an embodiment, the height $H_H$ of the receptacle housing 301 is smaller than the height of the at least the part of the plug 311. In an embodiment in which the at least the part of the plug has a circular cross-section, the height of the at least the part of the plug 311 corresponds to its diameter D, so that the height $H_H$ of the receptacle housing 301 is smaller than the diameter D of the at least the part of the plug 311.

Other aspects of the embodiment shown in FIGS. 3A and 3B are generally similar to those of the embodiment shown in FIGS. 1A to 2B.

Figure 4A:
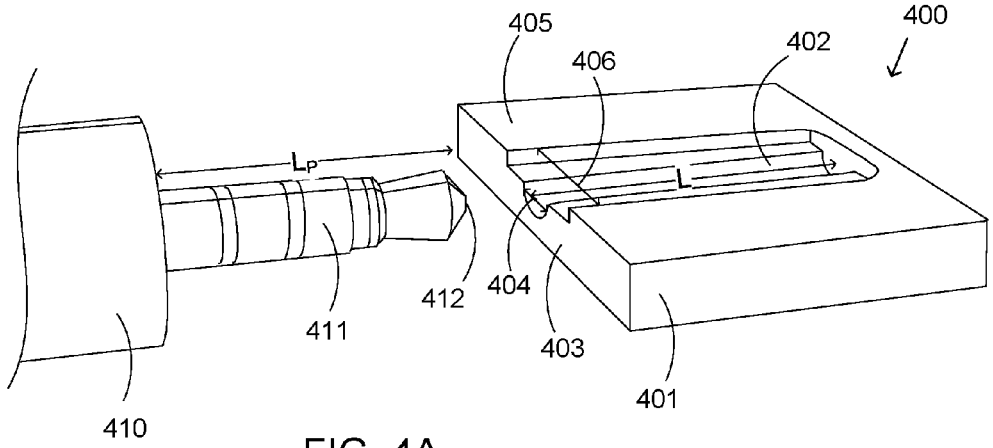
FIGS. 4A, 4B and 4C illustrate alternative perspective views and details of embodiments of a plug receptacle.
Figure 4B:
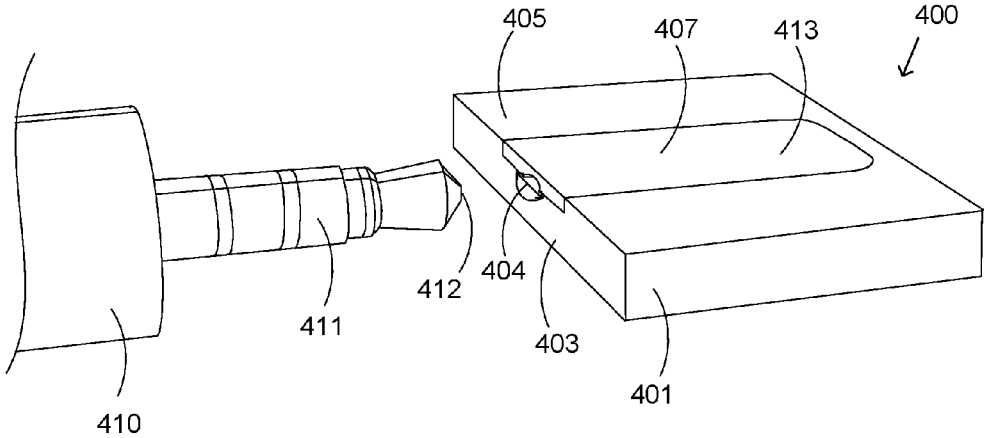

FIGS. 4A and 4B illustrate an exemplary embodiment of a plug receptacle 400 configured to receive at least a part of the plug 411 of a plug connector 410, in this embodiment a standard 2.5 mm or 3.5 mm audio connector. The plug 411 has a length $L_P$, which for a standard 2.5 mm audio connector may be 11 mm and for a standard 3.5 mm audio connector 14 mm. The plug 411 may also have a flat portion 412 at the tip, the flat portion being perpendicular to the longitudinal axis of the plug 411. The plug receptacle 400 is illustrated in FIG. 4A without the plug receptacle cover 407 and in FIG. 4B with the plug receptacle cover 407. In FIG. 4A, the receptacle housing 401 has a longitudinal passage 402, which is configured to receive and engage the at least the part of the plug 411. The longitudinal passage 402 may be longitudinally disposed within the receptacle housing 401. The receptacle housing 401 has a front side 403 having a first opening 404, via which the longitudinal passage 402 opens to the front side 403. The receptacle housing 401 further has a top side 405 having a second elongated opening 406, via which the longitudinal passage 402 opens to the top side 405. The longitudinal passage 402 has a length L in the direction of the longitudinal axis of the plug 411, i.e. in the direction of the length $L_P$ of the plug 411 when the at least a part of the plug 311 is received in the plug receptacle 300. In this embodiment, the length of the elongated second opening 406 is also equal to the length L of the longitudinal passage 402. The length L may be equal to or substantially equal to the length $L_P$ of the plug 411. It may also be smaller or greater than $L_P$.

In FIG. 4B, the plug receptacle cover 407 is in the cover position, and thus covers the second opening 406 which is not clearly visible. The plug receptacle cover 407 is recessed in the receptacle housing 401. In this embodiment, the plug receptacle cover 407 lies within the second opening 406 in the cover position. In an embodiment, the plug receptacle cover 407 lies within the longitudinal passage 402 in the cover position. In this embodiment, the plug receptacle cover 407 has a top side 413, which has a planar surface. The top side 413 of the plug receptacle cover 407 is flush with the top side 405 of the receptacle housing 401 in the cover position. In other words, the top surface of the top side 413 of the plug receptacle cover 407 is flush with the top surface of the top side 405 of the receptacle housing 401, i.e. the surface of the top side 413 of the plug receptacle cover 407 lies at the level defined by the surface of the top side 405 of the receptacle housing 401. In such an embodiment, the top side 413 of the plug receptacle cover 407 and the top side 405 of the receptacle housing 401 may feel seamless in the cover position. However, the top side 413 of the plug receptacle cover 407 may also be recessed within the top side 405 of the receptacle housing 401, or it may protrude or slightly protrude outwards from the top side 405 of the receptacle housing 401.

The size and shape of the plug receptacle cover 407 is not particularly limited. They may be selected depending on the type and size of plug it is intended to cover, on the size of the plug receptacle 400 and/or the size of an electronic device comprising the plug receptacle 400, or other considerations. The color of the plug receptacle cover 407, its material and/or other properties may be selected so that the plug receptacle cover 407 blends well in with the receptacle housing 401.

The first opening 404 and the second opening 406 intersect to form a continuous opening, to which the longitudinal passage 402 opens. When in use, the at least the part of the plug 411 may be inserted into the longitudinal passage 402 through the first opening 404. In this embodiment, the bottom of the longitudinal passage 402 has an arcuate or semi-circular cross-section, and the first opening 404 has a width that is greater than the width of the flat portion 412 at the tip of the plug 411. Thus the tip of the at least the part of the plug 411 can be inserted into the first opening 404 so that it slides into the longitudinal passage 402 below the plug receptacle cover 407, the at least the part of the plug 411 thereby forcing the plug receptacle cover 407 to extend outwards and into the open position. The first opening 404 and the space defined by the plug receptacle cover 407 and the longitudinal passage 402 thus function as a plug ramp for sliding the at least the part of the plug 411 underneath the plug receptacle cover 407. The height of the space defined by the plug receptacle cover 407 and the longitudinal passage 402 may be, for example, up to 3.5 mm, or up to 2 mm, or 1 to 2 mm. The height of the space defined by the plug receptacle cover 407 and the longitudinal passage 402 may also be higher than the height of the flat portion 412 at the tip of the plug 411.

In this embodiment, the plug receptacle cover 407 may be reversibly stretchable and/or resilient. In this embodiment, the entire plug receptacle cover 407 may be of a resilient material, such as any resilient material described in this specification. Other aspects of the embodiment shown in FIGS. 4A and 4B are generally similar to those of the embodiment shown in FIGS. 1A to 3B.

Figure 4C:
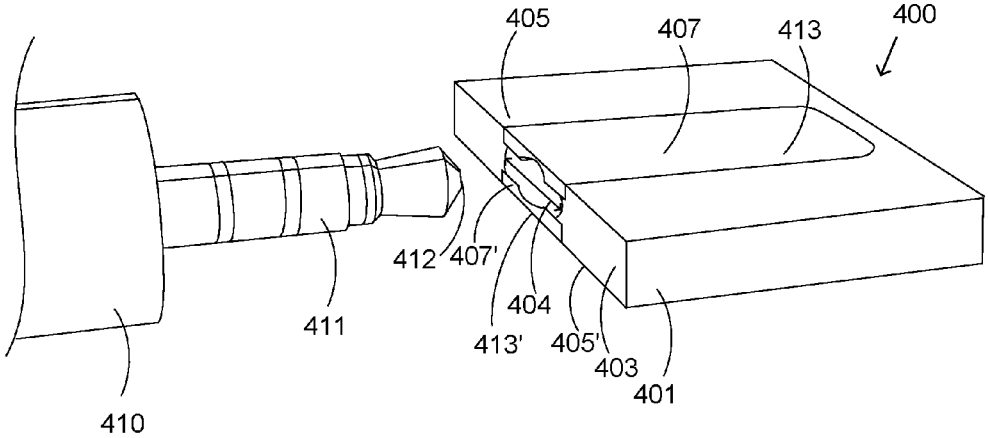

The plug receptacle 400 of FIG. 4C differs from that of FIGS. 4A and 4B at least in that the receptacle housing 401 has a bottom side 405' having a third opening, which, however, is not clearly visible in this FIG. The longitudinal passage 402 opens to the bottom side 405' via the third opening. The longitudinal passage 402 is configured to receive and engage at least a part of the plug 411 of a plug connector 410. In this exemplary embodiment, the longitudinal passage 402 has a partially circular cross-section. In other embodiments, the longitudinal passage 402 may have e.g. an arcuate or rectangular cross-section. However, other shapes for the cross-section of the longitudinal passage 402 may also be contemplated.

The plug receptacle 400 in this embodiment comprises a first plug receptacle cover 407 at the top side 405 and a second plug receptacle cover 407' at the bottom side 405'. In this exemplary embodiment, the entire first and second plug receptacle cover 407, 407' may be reversibly extendable. The first and second plug receptacle cover 407, 407' are thus extendable between a cover position and an open position. In an embodiment, the first and second plug receptacle cover 407, 407' are simultaneously extendable between a cover position and an open position. In FIG. 4C, both plug receptacle covers 407, 407' are shown in the cover position. In other embodiments, either one of the first or second plug receptacle cover 407, 407' or both could be replaced with a different type of plug receptacle cover, such as any one of the plug receptacle covers described in FIGS. 1A to 3B.

In the cover position, the first and second plug receptacle covers 407, 407' cover the second opening 406 and the third opening 406' of the receptacle housing 401, respectively, at least partially. In this embodiment, the first plug receptacle cover 407 has a top side 413, and the top side 413 of the plug receptacle cover 407 is flush with the top side 405 of the receptacle housing 401 in the cover position. The second plug receptacle cover 407' has a bottom side 413' which may likewise be flush with the bottom side 405' of the receptacle housing 401.

Upon being inserted into the plug receptacle 400, the at least the part of the plug 411 may force the reversibly extendable first and second plug receptacle covers 407, 407' to extend outwards. The plug receptacle cover 400 is thus configured to receive the at least the part of the plug 411. This exemplary embodiment is thus similar to that shown in FIGS. 3A and 3B.

In embodiments such as the embodiment shown in FIG. 4C, the receptacle housing 401 may be very thin, for example card-like. Other aspects of the embodiment shown in FIG. 4C are generally similar to those of the embodiment shown in FIGS. 1A to 4B.

Figure 5A:
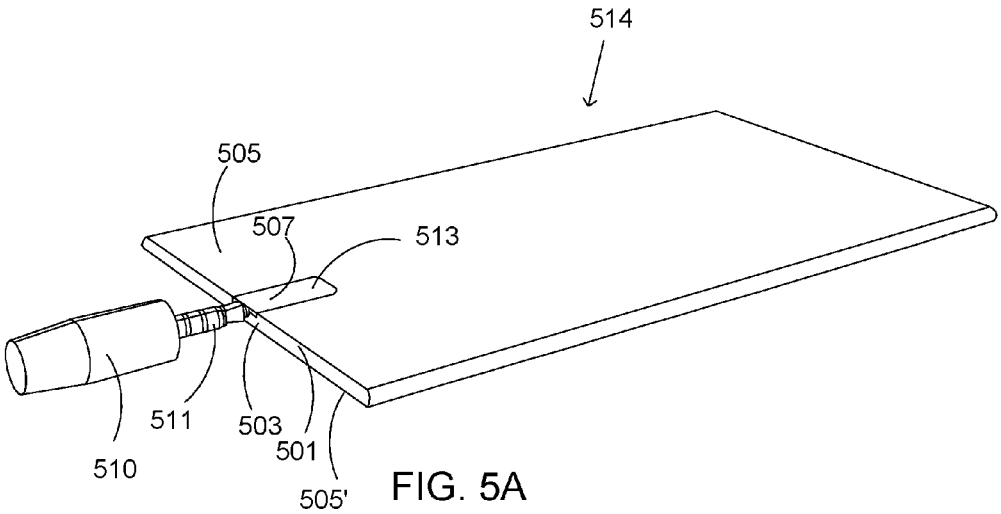
FIGS. 5A and 5B illustrate alternative perspective views and details of an embodiment of a plug receptacle and an electronic device.
Figure 5B:
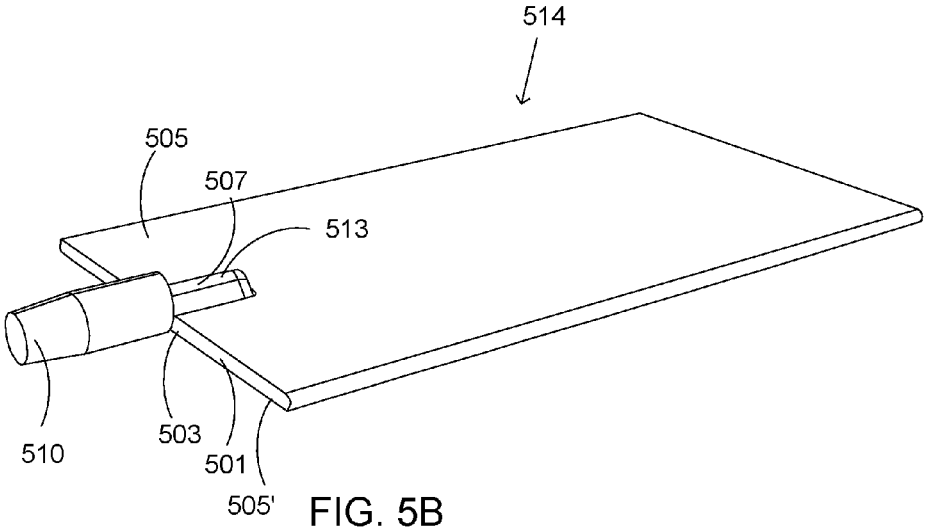

FIGS. 5A and 5B illustrate an embodiment of an electronic device 514. In an embodiment, the electronic device 514 comprises a plug receptacle 500 configured to receive at least a part of the plug 511 of a plug connector 510, in this embodiment a standard 2.5 mm or 3.5 mm audio connector. In an embodiment, the plug receptacle 500 is a part of the electronic device 514, for instance in embodiments in which the housing of the electronic device 514 also functions as the receptacle housing. In this embodiment, the electronic device 514, i.e. its housing, has a top side 505, and in the cover position illustrated in FIG. 5A, the top side 513 of the plug receptacle cover 507 is flush with the top side 505 of the housing of the electronic device 514. However, the top side 513 of the plug receptacle cover 507 may also be recessed within the top side 505 of the receptacle housing 501 or of the housing of the electronic device 514, or it may protrude or slightly protrude from the top side 505 of the receptacle housing 501 or of the housing of the electronic device 514 in the cover position.

In the open position illustrated in FIG. 5, the plug receptacle cover 507 or at least a part of the top side 513 thereof protrudes outwards from the top side 505 of the housing of the electronic device 514.

As illustrated in these FIGs., the electronic device 514 may be relatively thin, in particular when a plug 511 is not inserted. The thickness of the electronic device 514 may be e.g. up to 5.5 mm, or up to 4 mm, or up to 3 mm. In an embodiment, the electronic device has a thickness that is smaller than a height or diameter (outer diameter D) of the at least the part of the plug the housing is configured to receive. However, the electronic device 514 is not particularly limited to such thicknesses but may be thicker or thinner. Even in relatively thick electronic devices, the plug receptacle according to one or more embodiments described in this specification may save valuable space. The electronic device 514 may be, for instance, a tablet computer, a smartphone or a mobile phone, a phablet, a media player, a personal digital assistant, an e-book reader, a game console, a wearable device, a display or a flat-screen television. The electronic device 514 may comprise a touchscreen or another type of display. The touchscreen or other type of display may be disposed on the bottom side 505', not being visible in the FIGs, the top side 505 thus being the back side or a part of the back portion of the electronic device 514.

The electronic device 514 may comprise any plug receptacle described in this specification, such as the plug receptacles described in FIG. 2A, 2B or 4 comprising at least two plug receptacle covers, or any plug receptacle described in FIGS. 1A to 6C.

In an embodiment, at least a part of the plug receptacle cover 507 is radio-frequency (RF) transparent. At least a part of such a plug receptacle cover 507 may be of a RF transparent material. Examples of such RF transparent materials may include any non-conductive materials, such as rubber, silicone or plastic. In an electronic device 514 in which the cover or housing of the device, such as a unibody, is otherwise made of a metallic material or other material that is not RF transparent, such as aluminium, aluminium alloy, a magnesium alloy or other suitable metal, such a RF transparent part of the plug receptacle cover 507 may allow transmission of radio-frequency electromagnetic waves to and from one or more antennas or other RF components. One or more antennas, antenna feeds or other RF components may be disposed within the electronic device 514 below or in proximity of the plug receptacle cover 507. The size and the dimensions of the plug receptacle cover 507 or the part thereof that is RF transparent may be selected so that they are sufficient to allow the operation of one or more antennas, antenna feeds or other RF components. This may help in saving space within the electronic device. This may also help in eliminating the so-called antenna lines, i.e. slots in a metal unibody which allow antenna operation.

Other aspects of the embodiment shown in FIGS. 5A and 5B are generally similar to those of the embodiments shown in FIGS. 1A to 4C.

Figure 6A:
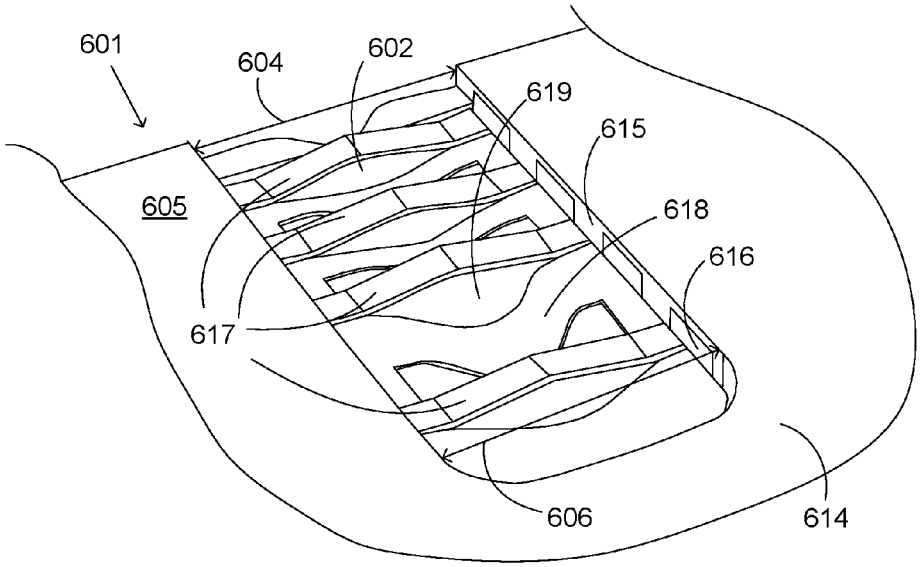
FIGS. 6A, 6B and 6C illustrate alternative perspective views and details of an embodiment of a plug receptacle and an electronic device.

The plug receptacle may comprise one or more electric contacts. The type and positions of the one or more electric contacts may depend on the type of plug the receptacle is configured to receive. The electronic device may further comprise connecting circuitry with which the electric contacts are in contact. FIG. 6A illustrates a perspective view of an exemplary embodiment of a plug receptacle 600 as a part of an electronic device 614. The receptacle housing 601 has a longitudinal passage, in this embodiment a longitudinal groove 602, a first opening 604 and a second opening 606, which openings intersect. The longitudinal groove 602 has opposite side walls 615 that are perpendicular to the top side 605 of the receptacle housing 601. There are a plurality of openings 616 in the side walls 615 of the longitudinal groove 602 to which the plug receptacle cover 607, not shown in FIG. 6A, may be attached.

The longitudinal groove 602 has a bottom 619 that may be essentially flat or planar, arcuate or partially circular. In this embodiment, a planar metal plate forms the bottom 619. The plug receptacle 600 comprises a plurality of electric contacts 617. The electric contacts 617 are configured to engage the at least the part of the plug 611 (not shown in FIG. 6A) when inserted. In this embodiment, the plug receptacle 600 comprises an electric contact arrangement including three, four or more electric contacts 617 configured to engage at least a part of the plug, such as the plug of a standard 2.5 mm or 3.5 mm audio connector. The electric contacts 617 are spaced apart along the length of the longitudinal groove 602. Each of the electric contacts 617 is a flat spring. Each of the electric contacts is thus configured to function as a spring which presses towards or against a contact surface of the at least the part of the plug 611. The electric contacts 617 are disposed transversely with respect to the length of the longitudinal groove 602. The length of the longitudinal groove 602 is parallel to the length (longitudinal axis) of the plug 611. The electric contacts 617 extend between the opposite side walls 615 of the longitudinal groove 602 and may extend wall to wall. However, other shapes and configurations of electric contacts 617 may also be contemplated. The electric contacts 617 may be formed, for example, of sheet metal or metal wire. In this exemplary embodiment, the electric contacts 617 are disposed between the bottom 619 of the longitudinal groove 602 and the plug receptacle cover 607, so that they are configured to be in contact with and thus engage the at least the part of the plug 611 and bend towards the bottom 619 of the longitudinal groove 602 when the at least the part of the plug 611 is received in the plug receptacle 600. With the electric contact arrangement shown in FIG. 6A, the thickness of the electric contact arrangement may be very small, e.g. approximately 0.3 mm when in use they are compressed towards the bottom 619 of the longitudinal groove 602.

A flex portion 618 is disposed below the electric contacts 617, i.e. between the electric contacts 617 and the bottom 619 of the longitudinal groove 602. The flex portion 618 may insulate the electric contacts 617 from the bottom 619 of the longitudinal groove. The flex portion 618 may be elastic, so that when in use, electric contacts 617 bending towards the bottom 619 of the longitudinal groove 602 may be in contact with the flex portion 618 without damaging it.

In another embodiment, the electric contacts are configured to contact the at least the part of the plug 611 from the lateral direction. They are thus arranged between the at least the part of the plug 611 and the side walls 615. The lateral direction may be generally parallel to the top side 605 of the receptacle housing 601. The lateral direction may be generally perpendicular to the length (longitudinal axis) of the at least the part of the plug 611 the plug receptacle 600 is configured to receive.

Figure 6B:
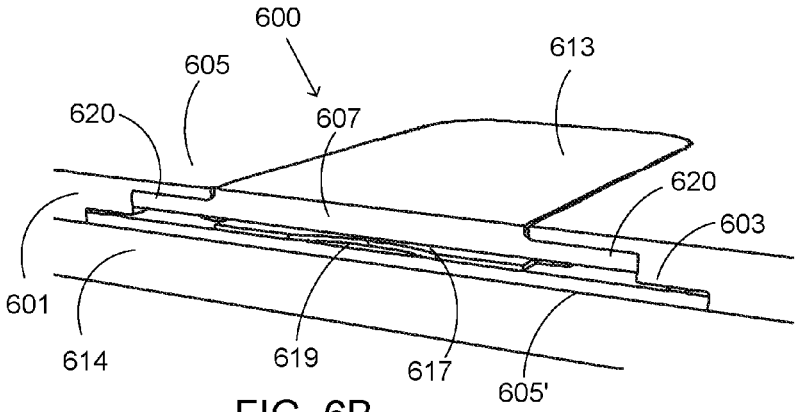

In FIG. 6B, the plug receptacle 600 is shown with the plug receptacle cover 607 in the cover position and covering the second opening 606. In this embodiment, the plug receptacle cover 607 is monolithic and formed of a resilient, stretchable material. The plug receptacle cover 607 has flanges 620 that extend below the top side 605 and into the plurality of openings 616 in the side walls 615 of the longitudinal groove 602 so that the plug receptacle cover 607 is attached to the receptacle housing 601 via the flanges 620. The flanges may be attached to the receptacle housing 601 mechanically or using an adhesive. In FIG. 6B, the first opening is not marked for clarity as it is very small in this embodiment. An electric contact 617 is visible in FIG. 6B, being disposed between the bottom 619 of the longitudinal groove 602 and the plug receptacle cover 607. In this exemplary embodiment, the plug receptacle 600 may be particularly thin. For example, for a standard 2.5 mm or 3.5 mm audio connector, the thickness (height) of the entire plug receptacle 600 from the bottom side 605' of the receptacle housing 601 to the top side 613 of the plug receptacle cover 607 in the cover position may be smaller than 2 mm, for example approximately 1.3 mm. For comparison, the thickness (height) of a standard 3.5 mm audio connector receptacle may be approximately 4 mm. In such an example, the flex portion 618 may be approximately 0.15 mm thick, the electric contacts 617 approximately 0.15 mm thick, the plug receptacle cover 607 may be approximately 0.7 mm thick and the bottom 619 of the longitudinal groove 602 may be approximately 0.3 mm thick. However, various other sizes for individual components and the plug receptacle 600 may be contemplated.

Figure 6C:
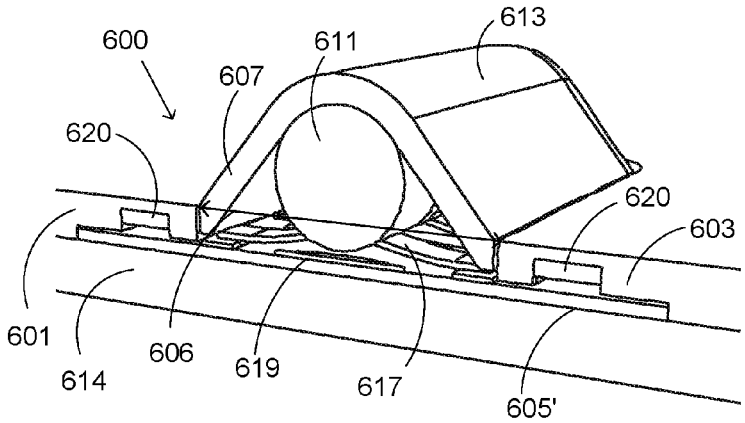

In FIG. 6C, the plug receptacle 600 is shown with the plug receptacle cover 607 in the open position, with a plug 611 (shown as a cross-sectional view) inserted and engaged by the plug receptacle 600. Upon being inserted into the plug receptacle 600, the at least the part of the plug 611 forces the reversibly stretchable plug receptacle cover 607 to stretch and thereby extend outwards, i.e. further away from the bottom 619 of the longitudinal groove 602. In the open position, at least a part of the plug 611 inserted extends through the second opening 606, i.e. beyond the top side 605 of the receptacle housing 601. In an embodiment, the plug receptacle cover 607 is configured to exert a force against the at least the part of the plug 611 in the open position.

Other aspects of the embodiment shown in FIG. 6A to 6C are generally similar to those of the embodiments shown in FIGS. 4A to 5B.

Some embodiments are further discussed shortly in the following.

In a first aspect, a plug receptacle may comprise a receptacle housing having a passage configured to receive at least a part of a plug of a plug connector, a front side having a first opening and a top side having a second, elongated opening that intersects the first opening, the passage opening to the front side via the first opening and to the top side via the second opening; and at least one plug receptacle cover that is reversibly extendable between a cover position and an open position, wherein in the cover position, the at least one plug receptacle cover covers the second opening at least partially; and in the open position, at least a part of the at least one plug receptacle cover is extended outwards, the plug receptacle thereby being configured to receive the at least the part of the plug so that the at least the part of the plug partially extends through the second opening.

In an embodiment which may be in accordance with the preceding embodiment, the passage is longitudinal.

In an embodiment which may be in accordance with any of the preceding embodiments, at least a part of the at least one plug receptacle cover is resilient.

In an embodiment which may be in accordance with any of the preceding embodiments, at least a part of the at least one plug receptacle cover is of a resilient material, the at least one plug receptacle cover being thereby reversibly stretchable between the cover position and the open position.

In an embodiment which may be in accordance with any of the preceding embodiments, the at least one plug receptacle cover comprises a pleated portion that is reversibly extendable.

In an embodiment which may be in accordance with any of the preceding embodiments, the at least one plug receptacle cover is configured to exert a force against the at least the part of the plug in the open position, thereby engaging the at least the part of the plug.

In an embodiment which may be in accordance with any of the preceding embodiments, the at least one plug receptacle cover has a top side, and in the cover position, the top side of the at least one plug receptacle cover is flush with the top side of the receptacle housing.

In an embodiment which may be in accordance with any of the preceding embodiments, the plug receptacle is an audio plug receptacle configured to receive at least a part of the plug of an audio plug connector.

In an embodiment which may be in accordance with any of the preceding embodiments, the plug receptacle is an audio plug receptacle configured to receive at least a part of the plug of a standard 2.5 mm or 3.5 mm audio plug connector.

In an embodiment which may be in accordance with any of the preceding embodiments, the receptacle housing has a height that is smaller than a height of the at least the part of the plug.

In an embodiment which may be in accordance with any of the preceding embodiments, the receptacle housing has a bottom side having a third, elongated opening that intersects the first opening, the passage opening to the bottom side via the third opening; and the plug receptacle comprises a first plug receptacle cover at the top side of the receptacle housing and a second plug receptacle cover at the bottom side of the receptacle housing, the first and second plug receptacle cover being reversibly extendable between a cover position and an open position, wherein in the cover position, the first plug receptacle cover covers the second opening at least partially and the second plug receptacle cover covers the third opening at least partially; and in the open position, at least a part of the first and second plug receptacle covers are extended outwards, the plug receptacle thereby being configured to receive the at least the part of the plug between the first and second receptacle cover so that the at least the part of the plug partially extends through the second and third opening.

In an embodiment which may be in accordance with any of the preceding embodiments, the first, second and third openings intersect to form a continuous opening via which the passage opens to the front side, top side and bottom side.

In an embodiment which may be in accordance with any of the preceding embodiments, the at least one plug receptacle cover is pretensioned in the cover position.

In an embodiment which may be in accordance with any of the preceding embodiments, the plug receptacle comprises a receptacle housing having a longitudinal passage configured to receive at least a part of a plug of an audio plug connector, a front side having a first opening and a top side having a second, elongated opening that intersects the first opening, the longitudinal passage opening to the front side via the first opening and to the top side via the second opening; and at least one plug receptacle cover that is reversibly stretchable between a cover position and an open position, wherein in the cover position, the at least one plug receptacle cover covers the second opening at least partially; and in the open position, at least a part of the at least one plug receptacle cover is stretched outwards, the plug receptacle thereby being configured to receive the at least the part of the plug so that the at least the part of the plug partially extends through the second opening.

In an embodiment which may be in accordance with any of the preceding embodiments, the longitudinal passage is a longitudinal groove.

In an embodiment which may be in accordance with any of the preceding embodiments, the plug receptacle comprises a plurality of electric contacts spaced apart along a length of the longitudinal groove between a bottom of the longitudinal groove and the at least one plug receptacle cover, the electric contacts being configured to engage the at least the part of the plug and bend towards the bottom of the longitudinal groove when the at least the part of the plug is received in the plug receptacle.

In an embodiment which may be in accordance with any of the preceding embodiments, the electric contacts are flat springs.

In an embodiment which may be in accordance with any of the preceding embodiments, the electric contacts are disposed transversely with respect to the length of the longitudinal groove.

In an embodiment which may be in accordance with any of the preceding embodiments, in the cover position, the longitudinal groove and the at least one plug receptacle cover define a space having a height smaller than a height of the at least the part of the plug.

In a second aspect, an electronic device may comprise a plug receptacle according to any one of the preceding embodiments.

In a third aspect, an electronic device may comprise a housing having a passage configured to receive at least a part of a plug of a plug connector, a front side having a first opening and a top side having a second, elongated opening that intersects the first opening, the passage opening to the front side via the first opening and to the top side via the second opening; and at least one plug receptacle cover that is reversibly extendable between a cover position and an open position, wherein in the cover position, the at least one plug receptacle cover covers the second opening at least partially, and in the open position, at least a part of the at least one plug receptacle cover is extended outwards, the electronic device thereby being configured to receive the at least the part of the plug so that the at least the part of the plug partially extends through the second opening.

In an embodiment which may be in accordance with the preceding embodiment, the passage is longitudinal.

In an embodiment which may be in accordance with any of the preceding embodiments, the at least one plug receptacle cover has a top side and the housing has a top side, and in the cover position, the top side of the at least one plug receptacle cover is flush with the top side of the housing.

In an embodiment which may be in accordance with any of the preceding embodiments, at least a part of the at least one plug receptacle cover is radio-frequency transparent.

In an embodiment which may be in accordance with the preceding embodiment, at least a part of the at least one plug receptacle cover is resilient.

In an embodiment which may be in accordance with any of the preceding embodiments, at least a part of the at least one plug receptacle cover is of a resilient material, the at least one plug receptacle cover being thereby reversibly stretchable between the cover position and the open position.

In an embodiment which may be in accordance with any of the preceding embodiments, the at least one plug receptacle cover comprises a pleated portion that is reversibly extendable.

In an embodiment which may be in accordance with any of the preceding embodiments, the at least one plug receptacle cover is configured to exert a force against the at least the part of the plug in the open position, thereby engaging the at least the part of the plug.

In an embodiment which may be in accordance with any of the preceding embodiments, the electronic device is configured to receive at least a part of the plug of an audio plug connector.

In an embodiment which may be in accordance with any of the preceding embodiments, the electronic device is configured to receive at least a part of the plug of a standard 2.5 mm or 3.5 mm audio plug connector.

In an embodiment which may be in accordance with any of the preceding embodiments, the housing has a height that is smaller than a height of the at least the part of the plug.

In an embodiment which may be in accordance with any of the preceding embodiments, the housing has a bottom side having a third, elongated opening that intersects the first opening, the passage opening to the bottom side via the third opening; and the electronic device comprises a first plug receptacle cover at the top side of the housing and a second plug receptacle cover at the bottom side of the housing, the first and second plug receptacle cover being reversibly extendable between a cover position and an open position, wherein in the cover position, the first plug receptacle cover covers the second opening at least partially and the second plug receptacle cover covers the third opening at least partially; and in the open position, at least a part of the first and second plug receptacle covers are extended outwards, the electronic device thereby being configured to receive the at least the part of the plug between the first and second receptacle cover so that the at least the part of the plug partially extends through the second and third opening.

In an embodiment which may be in accordance with any of the preceding embodiments, the first, second and third openings intersect to form a continuous opening via which the passage opens to the front side, top side and bottom side.

In an embodiment which may be in accordance with any of the preceding embodiments, the at least one plug receptacle cover is pretensioned in the cover position.

Although some of the present embodiments may be described and illustrated as being implemented in a smartphone, a mobile phone, or a tablet computer, these are only examples of a device and not a limitation. As those skilled in the art will appreciate, the present embodiments are suitable for application in a variety of different types of devices, such as portable and mobile devices, for example, in laptop computers, tablet computers, game consoles or game controllers, various wearable devices, etc.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The embodiments illustrated and described herein as well as embodiments not specifically described herein but within the scope of aspects of the claims constitute exemplary means for receiving at least a part of a plug of a plug connector. The receptacles 100, 200, 300, 400, 600, receptacle housings 101, 201, 301, 401, 501, 601 and passages 102, 202, 302, 402, 602 constitute exemplary receiving means for receiving at least a part of a plug of a plug connector. The plug receptacle covers 107, 207, 307, 407, 507, 607 constitute exemplary means for covering the plug receptacle and reversibly extending and optionally for engaging the at least a part of the plug. The electric contacts 617 illustrate exemplary electric contacting means for electrically engaging the at least the part of the plug.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The term "comprising" is used in this specification to mean including the feature(s) or act(s) followed thereafter, without excluding the presence of one or more additional features or acts.

The invention claimed is:

1. A receptacle, comprising:

a receptacle housing having a passage configured to receive at least a part of a plug of a plug connector, a front side having a first opening, a top side having a second opening that intersects the first opening, a bottom side having a third opening that intersects the first opening, the passage opening to the front side via the first opening, to the top side via the second opening, and to the bottom side via the third opening;

the receptacle housing comprises a first plug receptacle cover at the top side of the receptacle housing and a second plug receptacle cover at the bottom side of the receptacle housing; and the first and second plug receptacle covers being extendable between a cover position and an open position, wherein in the cover position, the first plug receptacle cover covers the second opening at least partially and the second plug receptacle cover covers the third opening at least partially; and in the open position, at least a part of the first and second plug receptacle covers are extended outwards from each other, the receptacle housing thereby being configured to receive the at least the part of the plug between the first and second plug receptacle covers so that the at least the part of the plug partially extends through the second and third openings.

2. The receptacle as defined in claim 1, wherein at least a part of the first plug receptacle cover is resilient.

3. The receptacle as defined in claim 1, wherein at least a part of the first plug receptacle cover is of a resilient material, the first plug receptacle cover being thereby stretchable between the cover position and the open position.

4. The receptacle as defined in claim 1, wherein the first plug receptacle cover comprises a pleated portion that is extendable.

5. The receptacle defined in claim 1, wherein the first plug receptacle cover is configured to exert a force against the at least the part of the plug in the open position, thereby engaging the at least the part of the plug.

6. The receptacle defined in claim 1, wherein the first plug receptacle cover has a top side, and in the cover position, the top side of the first plug receptacle cover is flush with the top side of the receptacle housing.

7. The receptacle defined in claim 1, wherein the receptacle is an audio plug receptacle configured to receive at least a part of the plug of a standard 2.5 mm or 3.5 mm audio plug connector.

8. The receptacle as defined in claim 1, wherein the receptacle housing has a height that is smaller than a height of the at least the part of the plug.

9. The receptacle defined in claim 1, wherein the first, second and third openings intersect to form a continuous opening via which the passage opens to the front side, top side and bottom side.

10. The receptacle defined in claim 1, wherein the first plug receptacle cover is pretensioned in the cover position.

11. The receptacle as defined in claim 1, wherein at least a part of the second plug receptacle cover is resilient.

12. A receptacle, comprising:

a receptacle housing having a longitudinal passage configured to receive at least a part of a plug of an audio plug connector, a front side having a first opening, a top side having a second opening that intersects the first opening, a bottom side having a third opening that intersects the first opening, the longitudinal passage opening to the front side via the first opening, to the top side via the second opening, and to the bottom side via the third opening;

the receptacle housing comprises a first plug receptacle cover at the top side of the receptacle housing and a second plug receptacle cover at the bottom side of the receptacle housing; and the first and second plug receptacle covers being stretchable between a cover position and an open position, wherein in the cover position, the first plug receptacle cover covers the second opening at least partially and the second plug receptacle cover covers the third opening at least partially; and in the open position, at least a part of the first and second plug receptacle covers are stretched outwards from each other, the receptacle housing thereby being configured to receive the at least the part of the plug between the first and second plug receptacle covers so that the at least the part of the plug partially extends through the second and third openings.

13. The receptacle as defined in claim 12, wherein the longitudinal passage is a longitudinal groove.

14. The receptacle as defined in claim 13, wherein in the cover position, the longitudinal groove and the first plug receptacle cover define a space having a height smaller than a height of the at least the part of the plug.

15. The receptacle as defined in claim 13, wherein the receptacle housing comprises a plurality of electric contacts spaced apart along a length of the longitudinal groove between a bottom of the longitudinal groove and the first plug receptacle cover, the electric contacts being configured to engage the at least the part of the plug and bend towards the bottom of the longitudinal groove when the at least the part of the plug is received in the receptacle housing.

16. The receptacle as defined in claim 15, wherein the electric contacts are flat springs.

17. The receptacle as defined in claim 15, wherein the electric contacts are disposed transversely with respect to the length of the longitudinal groove.

18. An electronic device, comprising:

a housing having a passage configured to receive at least a part of a plug of a plug connector, a front side having a first opening, a top side having a second opening that intersects the first opening, a bottom side having a third opening that intersects the first opening, the passage opening to the front side via the first opening, to the top side via the second opening, and to the bottom side via the third opening;

the housing comprises a first plug receptacle cover at the top side of the housing and a second plug receptacle cover at the bottom side of the housing; and the first and second plug receptacle covers being extendable between a cover position and an open position, wherein in the cover position, the first plug receptacle cover covers the second opening at least partially and the second plug receptacle cover covers the third opening at least partially, and in the open position, at least a part of the first and second plug receptacle covers are extended outwards from each other, the housing thereby being configured to receive the at least the part of the plug between the first and second plug receptacle covers so that the at least the part of the plug partially extends through the second and third openings.

19. The electronic device as defined in claim 18, wherein the first plug receptacle cover has a top side, and in the cover position, the top side of the first plug receptacle cover is flush with the top side of the housing.

20. The electronic device as defined in claim 18, wherein at least a part of the first plug receptacle cover is radio-frequency transparent.

* * * * *